United States Patent [19]

Tanaka

[11] Patent Number: 4,980,724

[45] Date of Patent: Dec. 25, 1990

[54] DEVELOPER MATERIAL CROSSMIXING APPARATUS

[75] Inventor: Shuji Tanaka, Fairport, N.Y.

[73] Assignee: Xerox Corporation, Stamford, Conn.

[21] Appl. No.: 366,722

[22] Filed: Jun. 15, 1989

[51] Int. Cl.[5] ..... G03G 15/06; B01F 7/00

[52] U.S. Cl. ..... 355/245; 366/319

[58] Field of Search ..... 355/245, 251, 253; 118/653, 657, 658; 366/81, 319

[56] References Cited

U.S. PATENT DOCUMENTS

| | | | |
|---|---|---|---|
| 4,071,226 | 1/1978 | Miller | 366/64 |
| 4,286,544 | 9/1981 | Witte | 118/657 |
| 4,361,109 | 11/1982 | Mayer et al. | 118/655 |
| 4,577,587 | 3/1986 | Kamezaki | 118/658 |
| 4,583,843 | 4/1986 | Ohata et al. | 355/253 |
| 4,711,551 | 12/1987 | Fujio et al. | 355/245 X |
| 4,723,143 | 2/1988 | Enomoto | 355/253 |
| 4,784,081 | 11/1988 | Knott | 118/657 X |
| 4,855,783 | 8/1989 | Takashima et al. | 118/658 X |

*Primary Examiner*—A. T. Grimley
*Assistant Examiner*—Nestor R. Ramirez
*Attorney, Agent, or Firm*—H. Fleischer; J. E. Beck; R. Zibelli

[57] ABSTRACT

An apparatus which mixes developer material in the chamber of a developer housing. An auger transports the developer material in an axial direction from one region of chamber to another region thereof. In addition, as the developer material is being advanced in the axial direction, it is being moved in a radial direction substantially perpendicular to the axial direction of movement. In this way, the charge characteristics of the developer material are provided.

1 Claim, 4 Drawing Sheets

DEVELOPER MATERIAL CROSSMIXING APPARATUS

This invention relates generally to an electrophotographic printing machine, and more particularly concerns an apparatus for mixing developer material used in the development system of the printing machine.

Generally, the process of electrophotographic printing includes charging a photoconductive member to a substantially uniform potential so as to sensitize the surface thereof. The charged portion of the photoconductive surface is exposed to a light image of an original document being reproduced. This records an electrostatic latent image on the photoconductive surface. After the electrostatic latent image is recorded on the photoconductive surface, the latent image is developed by bringing a developer mixture into contact therewith. A common type of developer material comprises carrier granules having toner particles adhering triboelectrically thereto. This two-component mixture is brought into contact with the photoconductive surface. The toner particles are attracted from the carrier granules to the latent image. This forms a toner powder image on the photoconductive surface which is subsequently transferred to a copy sheet. Finally, the toner powder image is heated to permanently fuse it to the copy sheet in image configuration.

A high speed commercial printing machine of this type uses a magnetic brush development system for developing the latent image. The magnetic brush system generally employs several developer rollers for transporting the developer material closely adjacent to the photoconductive surface. Augers are usually used to mix and disperse the developer material throughout the developer housing. During development, the toner particles are attracted from the carrier granules to the latent image. Thus, toner particles are depleted from the developer material during usage. It therefore becomes necessary to furnish additional toner particles to the system in order to maintain the concentration substantially constant. As the toner particles are depleted from the developer material, new toner particles are added thereto. However, the new toner particles frequently remain segregated from the carrier granules. In addition, the developer material in the chamber of the developer housing may have areas of high and low toner concentration. This may result in uneven development or areas of high background. It is, therefore, necessary to mix the toner particles with the carrier granules in order to maintain the desired triboelectric characteristics and to insure that the concentration of the toner particles throughout the developer material is substantially uniform. Various techniques have been devised for mixing the toner particles with the carrier granules. The includes other passive and active approaches. In a passive approach, different types of baffles are employed for controlling the direction of flow of the toner particles and carrier granules so as to optimize mixing therebetween. In an active system, the mixing device moves so as to mix the carrier granules and toner particles with one another. Various types of active systems have been devised for mixing toner particles and carrier granules with one another. The following disclosures appear to be relevant:

U.S. Pat. No. 4,286,544, Patentee: Witte, Issued: Sept. 1, 1981,

U.S. Pat. No. 4,361,109, Patentee: Mayer et al., Issued: Nov. 30, 1982,

U.S. Pat. No. 4,583,843, Patentee: Ohata et al., Issued: Apr. 22, 1986,

U.S. Pat. No. 4,711,551, Patentee: Fujio et al., Issued: Dec. 8, 1987,

U.S. Pat. No. 4,723,143, Patentee: Enomoto, Issued: Feb. 2, 1988,

The relevant portions of the foregoing disclosures may be briefly summarized as follows:

U.S. Pat. No. 4,286,544 discloses a developer roller having a plurality of spaced conical member disposed interiorly thereof along the shaft for cross mixing. The developer roller includes spaced, longitudinal magnetic strips extending substantially parallel to the shaft for advancing developer material to the latent image.

U.S. Pat. No. 4,361,109 describes a crossmixing device having a left handed and a right handed threaded portion to move developer material from either side toward the middle.

U.S. Pat. No. 4,583,843 discloses a developer applicator having a plurality of applicator blades extending in a widthwise direction. A helical blade is mounted rotatably interiorly of developer applicator to move the developer material from one end to the other end thereof.

U.S. Pat. No. 4,711,551 describes a screw conveyor having a spiral stirring blade for mixing the developer material. The stirring blade is cut out at nearly the center of the conveyor or formed in a discontinuous fashion.

U.S. Pat. No. 4,723,143 discloses a conveyor having agitating blades mounted on a shaft. A plurality of spaced blades, on each side of the shaft center, are titled toward the center. Each set of plurality of blades is inversed at the shaft center. A plate extending outwardly from the shaft extends between each plate.

In accordance with one aspect of the present invention, there is provided an apparatus for mixing developer material. The apparatus includes a housing defining a chamber storing a supply of developer material therein. Means are provided for transporting the developer material in an axial direction from one region of the chamber of the housing to another region thereof. Substantially simultaneously developer material is moved in a radial direction substantially perpendicular to the axial direction of movement so as to improve the charge characteristics of the developer material.

Pursuant to another aspect of the present invention, there is provided an electrophotographic printing machine of the type in which an electrostatic latent image recorded on a photoconductive member is developed with a developer material. The improvement includes a housing defining a chamber storing a supply of developer material therein. Means, disposed, at least partially in the chamber of said housing, are provided for developing the electrostatic latent image recorded on the photoconductive member with developer material. Means transport developer material in an axial direction from one region of the chamber of the housing to another region thereof. Substantially simultaneously, developer material is moved in a radial direction substantially perpendicular to the axial direction of movement so as to improve the charge characteristics of the developer material.

Still a further aspect of the present invention is an apparatus for developing a latent image recorded on a member with developer material comprising at least carrier granules and toner particles. The apparatus includes a housing defining a chamber storing a supply of developer material therein. Means, disposed, at least partially in the chamber of the housing, advance developer material closely adjacent to the latent image so that the latent image attracts toner particles thereto forming a toner powder image on the member. An auger is mounted rotatably in the chamber of the housing for transporting the developer material in an axial direction from one region of the chamber of said housing to another region thereof. Substantially simultaneously therewith, developer material is moved in a radial direction substantially perpendicular to the axial direction of movement so as to improve the charge characteristics of the developer material.

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Inasmuch as the art of electrophotographic printing is well known, the various processing stations employed in the FIG. 1 printing machine will be shown hereinafter schematically and their operation described briefly with reference thereto.

Figure 1:
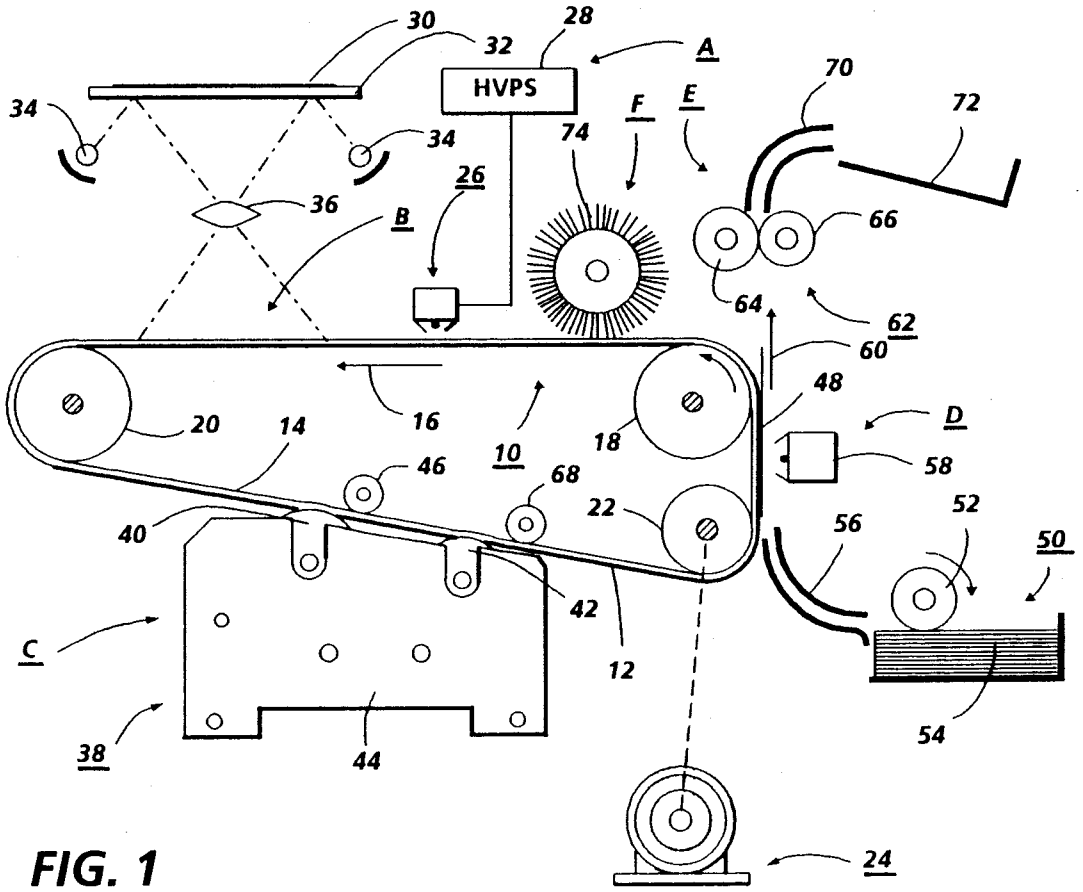
FIG. 1 is a schematic elevational view of an illustrative electrophotographic printing machine incorporating a mixing apparatus having the features of the present invention therein.

Referring initially to FIG. 1, there is shown an illustrative electrophotographic printing machine incorporating the crossmixing apparatus of the present invention therein. The electrophotographic printing machine employs a belt 10 having a photoconductive surface 12 deposited on a conductive substrate 14. Preferably, photoconductive surface 12 is made from a selenium alloy. Conductive substrate 14 is made preferably from an aluminum alloy which is electrically grounded. Belt 10 moves in the direction of arrow 16 to advance successive portions of photoconductive surface 12 sequentially through the various processing stations disposed about the path of movement thereof. Belt 10 is entrained about stripping roller 18, tensioning roller 20 and drive roller 22. Drive roller 22 is mounted rotatably in engagement with belt 10. Motor 24 rotates roller 22 to advance belt 10 in the direction of arrow 16. Roller 22 is coupled to motor 24 by suitable means, such as a drive belt. Belt 10 is maintained in tension by a pair of springs (not shown) resiliently urging tensioning roller 20 against belt 10 with the desired spring force. Stripping roller 18 and tensioning roller 20 are mounted to rotate freely.

Initially, a portion of belt 10 passes through charging station A. At charging station A, a corona generating device, indicated generally by the reference numeral 26 charges photoconductive surface 12 to a relatively high, substantially uniform potential. High voltage power supply 28 is coupled to corona generating device 26. Excitation of power supply 28 causes corona generating device 26 to charge photoconductive surface 12 of belt 10. After photoconductive surface 12 of belt 10 is charged, the charged portion thereof is advanced through exposure station B.

At exposure station B, an original document 30 is placed face down upon a transparent platen 32. Lamps 34 flash light rays onto original document 30. The light rays reflected from original document 30 are transmitted through lens 36 to form a light image thereof. Lens 36 focuses this light image onto the charged portion of photoconductive surface 12 to selectively dissipate the charge thereon. This records an electrostatic latent image on photoconductive surface 12 which corresponds to the informational areas contained within original document 30.

After the electrostatic latent image has been recorded on photoconductive surface 12, belt 10 advances the latent image to development station C. At development station C, a magnetic brush development system, indicated generally by the reference numeral 38, advances developer material into contact with the latent image. Preferably, magnetic brush development system 38 includes two magnetic brush developer rollers 40 and 42. Rollers 40 and 42 advance developer material into contact with the latent image. These developer rollers form a brush of carrier granules and toner particles extending outwardly therefrom. The latent image attracts toner particles from the carrier granules forming a toner powder image thereon. Developer rollers 40 and 42 are mounted, at least partially, in the chamber of developer housing 44. The chamber in developer housing 44 stores a supply of developer material therein. A toner container dispenses additional toner particles into the developer material in the chamber of the developer housing as toner particles are depleted therefrom due to the development of the latent image. These fresh toner particles are mixed with the developer material in the chamber of the developer housing. Crossmixing of the developer material and fresh toner particles is achieved by the crossmixing apparatus of the present invention which will be described hereinafter in greater detail with reference to FIGS. 2 through 4, inclusive. Guide rollers 46 and 68 deflect belt 10 so that a portion of belt 10 is wrapped about a region of the exterior circumferential surface of rollers 40 and 42 to form extended development zones about each of the developer rollers.

With continued reference to FIG. 1, after the electrostatic latent image is developed, belt 10 advances the toner powder image to transfer station D. A copy sheet 48 is advanced to transfer station D by sheet feeding apparatus 50. Preferably, sheet feeding apparatus 50 includes a feed roll 52 contacting the uppermost sheet of stack 54. Feed roll 52 rotates to advance the uppermost sheet from stack 54 into chute 56. Chute 56 directs the advancing sheet of support material into contact with photoconductive surface 12 of belt 10 in a timed sequence so that the toner powder image developed thereon contacts the advancing sheet at transfer station D. Transfer station D includes a corona generating device 58 which sprays ions onto the back side of sheet 48. This attracts the toner powder image from photoconductive surface 12 to sheet 48. After transfer, sheet 48 continues to move in the direction of arrow 60 onto a conveyor (not shown) which advances sheet 48 to fusing station E.

Fusing station E includes a fuser assembly, indicated generally by the reference numeral 62, which permanently affixes the transferred powder image to sheet 48. Fuser assembly 60 includes a heated fuser roller 64 and a back-up roller 66. Sheet 48 passes between fuser roller 64 and back-up roller 66 with the toner powder image contacting fuser roller 64. In this manner, the toner powder image is permanently affixed to sheet 48. After fusing, sheet 48 advances through chute 70 to catch tray 72 for subsequent removal from the printing machine by the operator.

After the copy sheet is separated from photoconductive surface 12 of belt 10, the residual toner particles adhering to photoconductive surface 12 are removed therefrom at cleaning station F. Cleaning station F includes a rotatably mounted fibrous brush 74 in contact with photoconductive surface 12. The particles are cleaned from photoconductive surface 12 by the rotation of brush 74 in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the crossmixing apparatus of the present invention therein.

Figure 2:
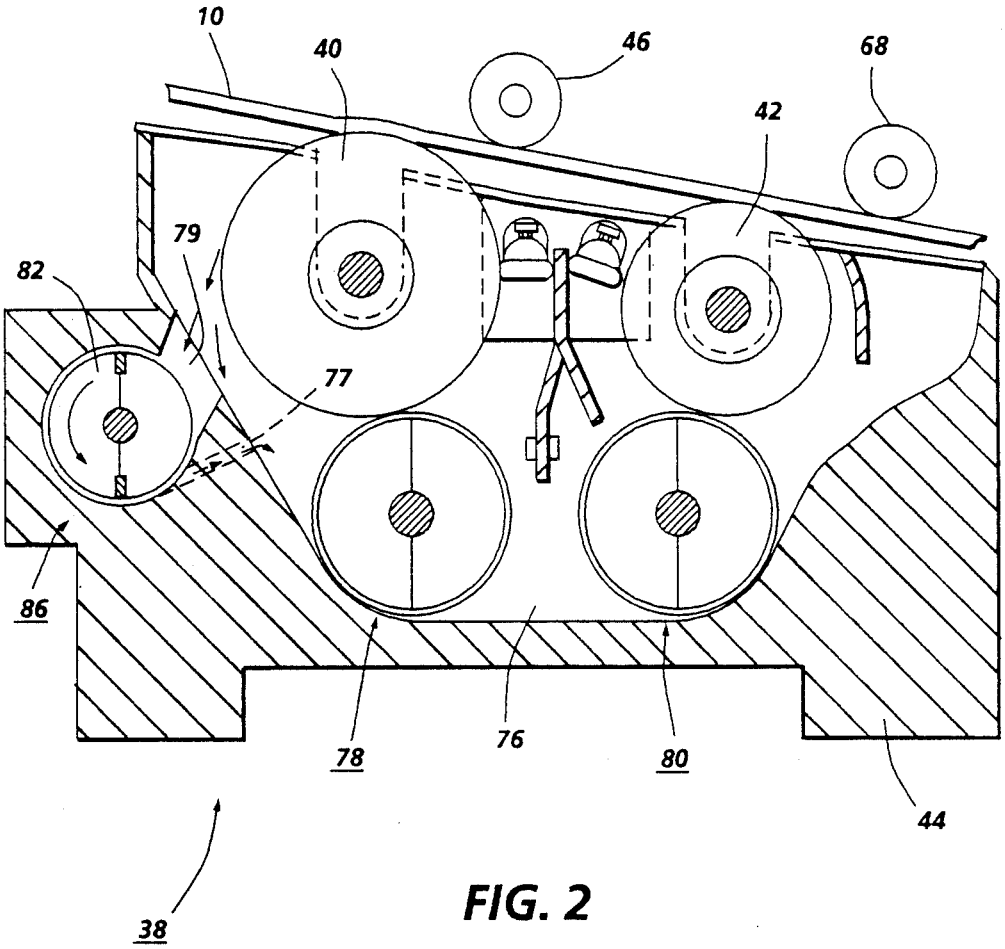
FIG. 2 is a side elevational view showing the development apparatus used in the FIG. 1 printing machine.

Referring now to FIG. 2, there is shown development system 38 in greater detail. As shown thereat, development system 38 includes a housing 44 defining a chamber 76 for storing a supply of developer material therein. Developer rollers 40 and 42 are mounted in chamber 76 of housing 44 and positioned closely adjacent to belt 10, i.e. a portion of belt 10 is wrapped about developer rollers 40 and 42. Guide rollers 46 and 68 engage the backside of belt 10 and position belt 10 so that a portion thereof wraps about a region of developer roller 46 forming an extended development zone ranging from about 5° to about 25°. Another portion of belt 10 wraps about a region of developer roller 42 forming an extended development zone ranging from about 5° to about 25°. Preferably, developer rollers 40 and 42 each include a non-magnetic tubular member made preferably from aluminum and having the exterior circumferential surface thereof roughened. An elongated magnet is positioned interiorly of and spaced from the tubular member. The magnet is mounted stationarily and generates a low magnetic field in the development zone to permit high agitation of the developer material thereat. The tubular member rotates to advance the developer material adhering thereto into the development zone where the toner particles are attracted from the carrier granules to the latent image recorded on photoconductive surface 12 of belt 10.

With continued reference to FIG. 2, augers, indicated generally by the reference numerals 78 and 80, are located in chamber 76 of housing 44. Augers 78 and 80 are substantially identical to one another. Each of the augers is mounted rotatably in chamber 76 to mix and transport developer material. Each auger has blades extending spirally outwardly from a shaft. The blades are designed to advance the developer material in the axial direction substantially parallel to the longitudinal axis of the shaft. Augers 78 and 80 rotate in opposite directions to advance the developer material in opposite direction. In this way, the developer material moves in a recirculating path. Auger 86 is mounted rotatably in an opening the developer housing. Auger 86 has blades extending spirally outwardly from a shaft. In addition, paddles are mounted on the uppermost region of each set of blades. The paddles move the developer material in the radial direction, i.e. substantially perpendicular to the axial direction of movement of the developer material. New toner particles are discharged into the chamber of the developer housing from a toner container (not shown). These toner particles are mixed with the developer material by auger 86. In this way, the developer material is mixed and dispersed with the admix and uniformity being improved. This improves the charge characteristics of the developer material. Augers 78 and 80 are substantially equal in size. Auger 78 transports developer material to developer roller 40 and auger 80 transports developer material to developer roller 42. The centers of augers 78 and 80 lie in a common plane that is substantially parallel to the horizontal plane. Inasmuch as housing 44 and chamber 76 are level, the developer material flow in each of the augers can be balanced. Hence, auger 78 transports substantially the same amount of developer material as auger 80. In this way, the mixing of the developer material though out chamber 76 is substantially uniform and each developer roller has substantially the same quantity of developer material transported thereto. Auger 86 is smaller in diameter than augers 78 and 80. After development of the electrostatic latent image, a portion of the developer material on developer roller 40 passes through opening 79 onto auger 86 at one end thereof. The developer material is mixed as auger 86 moves the developer material in an axial and radial direction. Opening 77 is located at the other end of auger 86. Auger 86 moves the material from opening 79 to opening 77. The mixed developer material is discharged through opening 77 onto auger 78.

As successive electrostatic latent images are developed, the toner particles within the developer material are depleted. A toner dispenser (not shown) stores a supply of toner particles. The toner dispenser is in communication with chamber 76 of housing 44 As the concentration of toner particles in the developer material is decreased, fresh toner particles are furnished to the developer material in the chamber from the toner dispenser. The augers in the chamber of the housing mix the fresh toner particles with the remaining developer material so that the resultant developer material therein is substantially uniform with the concentration of toner particles being optimized.

Figure 3:
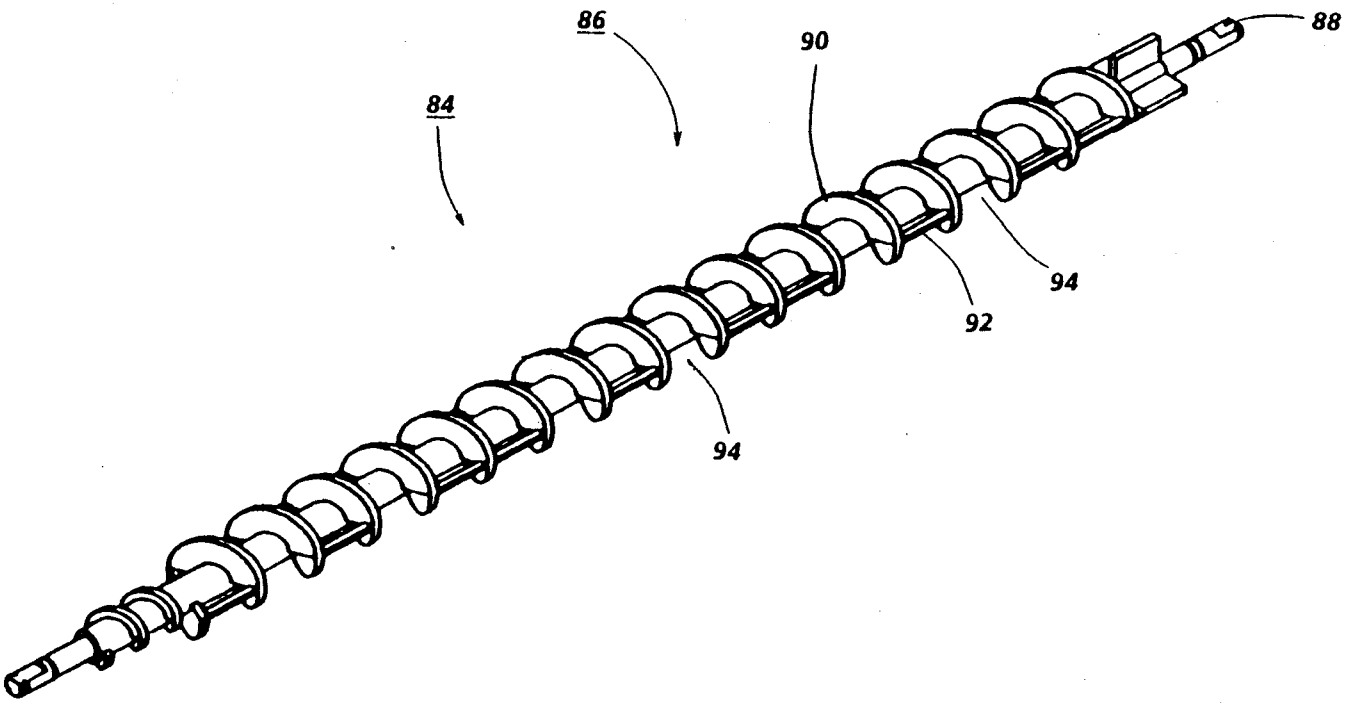
FIG. 3 is a perspective view of the mixing auger used in the FIG. 2 development apparatus.
Figure 4:
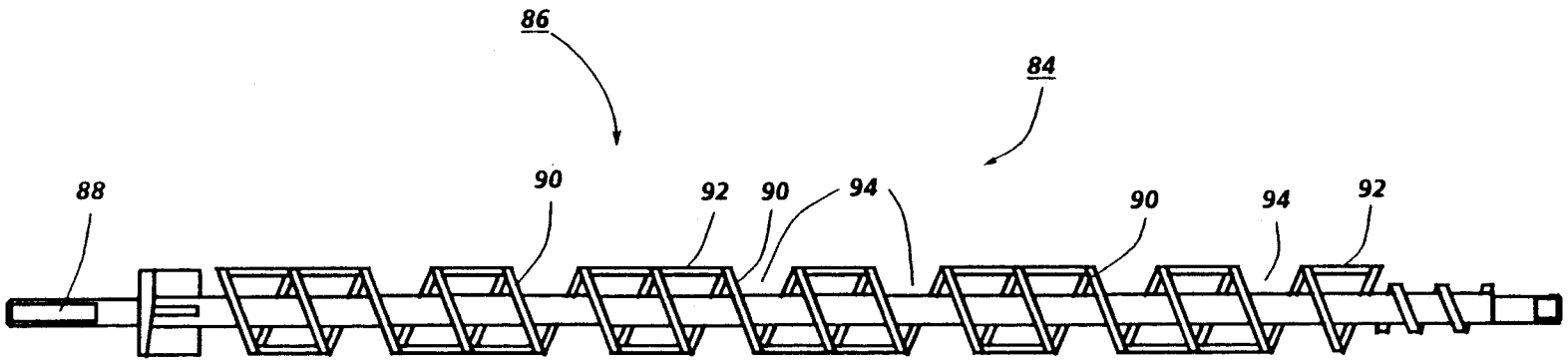
FIG. 4 is an elevational view of the FIG. 3 mixing auger.

Referring now to FIGS. 3 and 4, the augers 86 will be described in greater detail. Auger 86 includes a developer material transport 84 having a shaft 88 with a plurality of blades 90 spirally wound thereabout. Blades 90 are mounted in spaced sets and extend outwardly from shaft 88. Each set of blades includes at least one paddle 92 connecting the upper region of adjacent blades 90. Paddle 92 is spaced from shaft 88. Adjacent sets of blades 92 are spaced from one another by a region 94 therebetween which does not have paddle 92. Shaft 88 is coupled to a suitable motor and rotated in tube 82 (FIG. 2). As shaft 88 rotates blades 90 advance the developer in an axial direction substantially parallel to the longitudinal axis of shaft 88. Substantially simultaneously, paddles 92 move the developer material in a radial direction substantially perpendicular to the longitudinal axis of shaft 88. Preferably, developer material transport 84 is made from a molded plastic material having a diameter of about 30 millimeters. Blades 90 are inclined with respect to the longitudinal axis of shaft 88 at an angle of about 66°. The pitch is about 20 millimeters.

In recapitulation, it is evident that the cross mixing apparatus of the present invention includes a developer material transport which advances the developer material in an axial and radial direction. This improves mixing of the developer material as well as enhancing the charge characteristics of the developer material. The developer material transport is a molded plastic member having blades spirally wound about a shaft with paddles connecting sets of blades. The paddles are spaced from the shaft. The blades advance the developer material in the axial direction and the paddles move the developer material in the radial direction.

It is, therefore, apparent that there has been provided in accordance with the present invention, a development system that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. An apparatus for developing a latent image recorded on a member with developer material comprising at least carrier granules and toner particles, including:

a housing defining a chamber storing a supply of developer material therein;

means, disposed, at least partially in the chamber of said housing, for advancing developer material closely adjacent to the latent image so that the latent image attracts toner particles thereto forming a toner powder image on the member; and an auger mounted rotatably in the chamber of said housing, said auger comprising a shaft, a plurality of sets of blades mounted spirally on said shaft and extending outwardly therefrom so as to transport developer material in an axial direction substantially parallel to the longitudinal axis of said shaft, and a plurality of paddles spaced from said shaft and extending in a direction substantially parallel to said shaft and having opposed ends mounted on adjacent blades of said set of blades with each set of blades having a paddle mounted thereon and adjacent sets of blades being spaced from one another to move the developer material in a radial direction substantially perpendicular to the axial direction of movement so as to improve the charge characteristics of the developer material.

* * * * *